United States Patent [19]

Sullivan

[11] 4,300,368

[45] Nov. 17, 1981

[54] HANDCUFF ASSEMBLY

[76] Inventor: David M. Sullivan, 35 S. Evergreen, Memphis, Tenn. 38104

[21] Appl. No.: 146,454

[22] Filed: May 5, 1980

[51] Int. Cl.[3] ..... E05B 75/00

[52] U.S. Cl. ..... 70/16

[58] Field of Search ..... 70/14, 15, 16, 17; 119/100, 126, 127, 128

[56] References Cited

U.S. PATENT DOCUMENTS 2,759,349 8/1956 McKee ..... 70/16

FOREIGN PATENT DOCUMENTS 6808902 12/1969 Netherlands ..... 70/16

*Primary Examiner*—Robert L. Wolfe

*Attorney, Agent, or Firm*—Walker & McKenzie

[57] ABSTRACT

A handcuff assembly for use by law enforcement officers to lock a prisoner's wrists together. A pair of handcuffs are connected together by a linkage that prevents flexion, rotation, and adduction of the prisoner's hand and wrist, muscles, etc., while allowing the assembly to fold flat for storage while also being capable of folding over an equipment belt.

12 Claims, 7 Drawing Figures

HANDCUFF ASSEMBLY

BACKGROUND OF THE INVENTION

1. Field of the Invention

The present invention relates in general to handcuff assemblies for selectively locking a prisoner's wrists substantially together.

2. Description of the Prior Art

Heretofore, various handcuff assemblies have been developed. See, for example, Tompkins, U.S. Pat. Nos. 2,966,797; Smith, U.S. Pat. 3,618,345; and Lai, U.S. Pat. 4,089,195. None of the above patents disclose or suggest the present invention.

Typical handcuffs now used by law enforcement officers are normally joined together by a chain link assembly. However, such chain link assemblies are disadvantageous because they fail to restrict the movement of a prisoner's hands and are susceptible to being broken at the swivel if the prisoner, through manipulation of his hands, causes the swivel to become locked or otherwise non-rotatable and then exerts sufficient torque on the swivel causing it to break. The handcuffs themselves can be used for leverage to break the swivel thereby freeing the prisoner's arms.

Also, law enforcement officers are encountering a large number of prisoner's who have keys to the handcuff assemblies. Officers are not always able to discover handcuff keys hidden on a prisoner's person due to the haste of an arrest search. The officer is thereby endangered if the prisoner, who is thought to be restrained, escapes from the handcuffs with the aid of a hidden key or the like. Officers are also finding that a prisoner handcuffed by typical handcuff assemblies can reach into his pockets and remove evidence and dispose of it or otherwise destroy it before the prisoner can be more thoroughly searched at headquarters. Further, a prisoner's whose hands have been handcuffed behind his back with a typical handcuff assembly can often slip his hands from behind his back and bring them in front of him (i.e., "step through" the handcuff assembly) thereby allowing more freedom of movement in escaping from the handcuff assembly, etc.

SUMMARY OF THE INVENTION

The overall objective of the present invention is to provide a law enforcement officer with the maximum amount of safety during and after restraining a prisoner with a handcuff assembly. The following are more specific objectives:

1. To provide a handcuff assembly which when applied to a prisoner's wrists restricts flexion, rotation and adduction of the prisoner's hand and wrists muscles and tendons such that if the prisoner were to have the key to the handcuffs in either hand, he would be unable to maneuver the key into the keyhole and turn it so as to escape from the handcuff assembly, etc.

2. To provide a handcuff assembly which would, when applied to a prisoner's wrists, prevent or greatly reduce his ability to extend his arms so as to prevent him from sliding his hands from behind his back and beneath his feet thereby bringing his hands in front of him. This is prevented by putting the handcuff assembly on the prisoner's wrists with his arms in a horizontal position on top of each other.

3. To provide a handcuff assembly with a connecting means that is incapable of being twisted or otherwise maneuvered into a position so that leverage could cause it to break.

4. To provide a handcuff assembly with a connecting means comprised of solid links which are hinged quarterly and which pivot on pins that are completely enclosed within the frame of the handcuffs and can not be tampered with and with the hinge pins at the quarter positions being knock-out proof by being made wider in the middle than at the ends.

5. To provide a handcuff assembly with a connecting means limited to substantially a 190° lateral movement so that a prisoner restrained therein would be unable to get leverage on the link to break it by maneuvering his arms and hands.

6. To provide a handcuff assembly with two independent connecting means so that if one should fail, the other would be sufficiently strong enough to adequately hold the handcuffs together.

7. To provide a handcuff assembly with a connecting means which allows the handcuffs to fold completely flat, one on top of the other, for easy storage in a handcuff case.

8. To provide a handcuff assembly with a connecting means which allows the handcuffs to be comfortably carried over a normal belt or a "Sam Brown" type equipment belt without protruding.

9. To provide a handcuff assembly with a push button double locking device so that an officer can easily and rapidly apply the double lock with his thumb after the handcuffs have been replaced on a prisoner.

10. To provide a handcuff assembly with a push button double locking device in which the double lock activating pin is located in a counter sunk hole in order to prevent accidental activation of the double lock.

The handcuff assembly of the present invention includes, in general, a first wrist encircling means for selectively encircling one of a prisoner's wrists; a second wrist encircling means for selectively encircling the other of the prisoner's wrists; and a connecting means for pivotally connecting the first and second encircling means to one another, the connecting means including a first body means having a first end pivotally attached to the first wrist encircling means and having a second end, the connecting means including a second body means having a first end pivotally attached to the second wrist encircling means and having a second end, the connecting means including the coupling means for pivotally coupling the second ends of the first and second link members to one another.

DESCRIPTION OF THE PREFERRED EMBODIMENT

The handcuff assembly 11 of the present invention is for use by law enforcement officers and the like to selectively lock a prisoner's wrists together to thereby restrain the prisoner when arresting the prisoner. The handcuff assembly 11 includes, in general, a first wrist encircling handcuff or means 13, a second wrist encircling handcuff or means 15, and a connecting means 17 for pivotally connecting the first and second wrist encircling means 13, 15 to one another.

Figure 1:
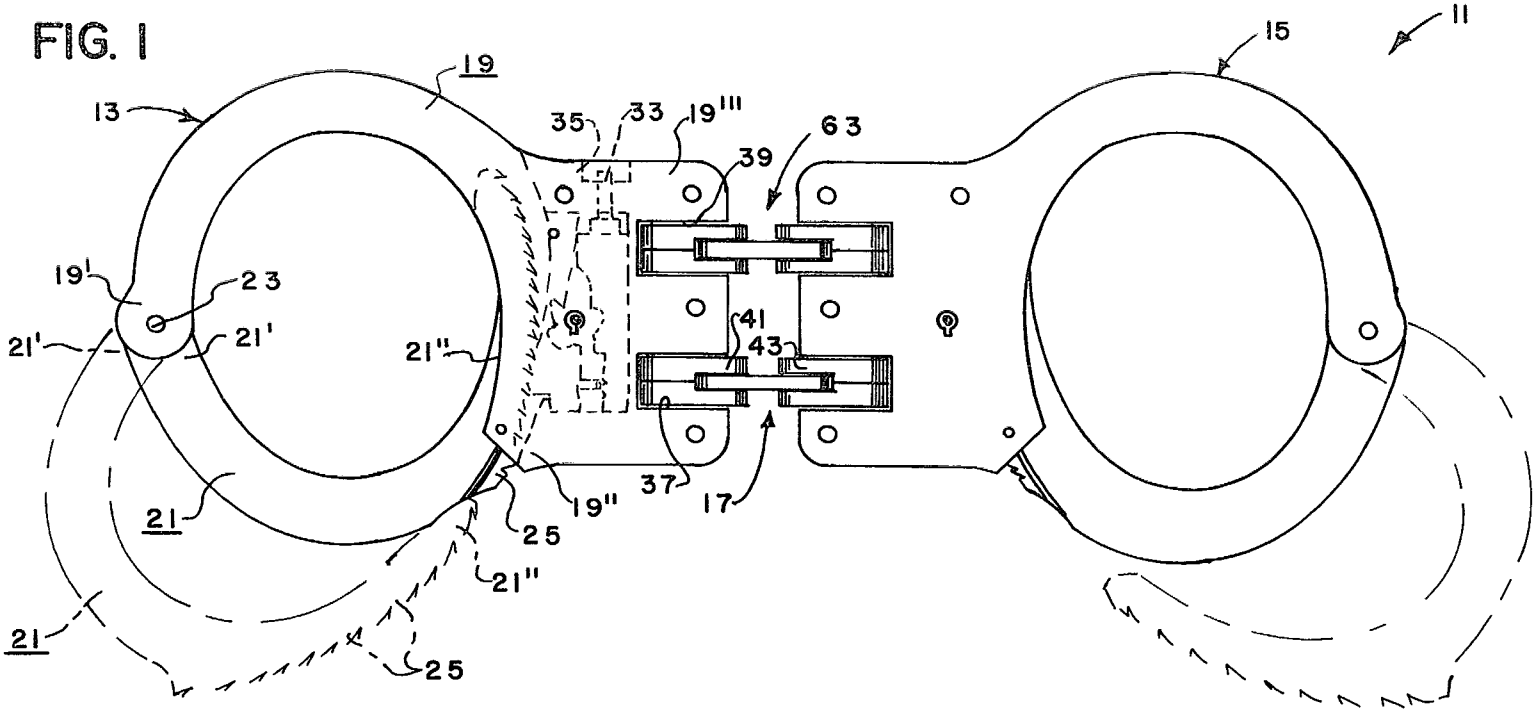
FIG. 1 is a front elevational view of the handcuff assembly of the present invention.
Figure 2:
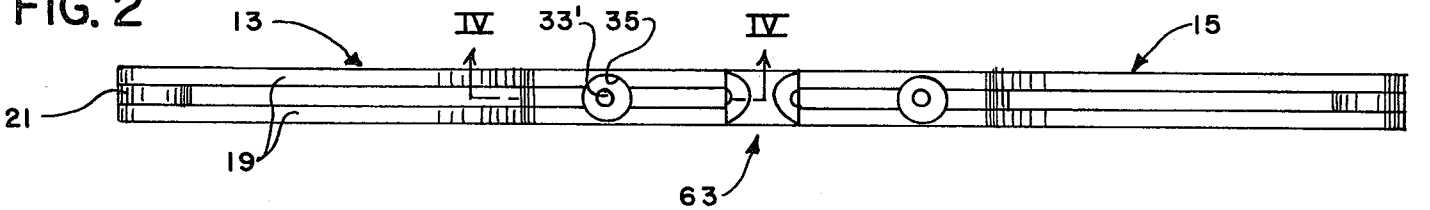
FIG. 2 is a top plan view thereof.
Figure 3:
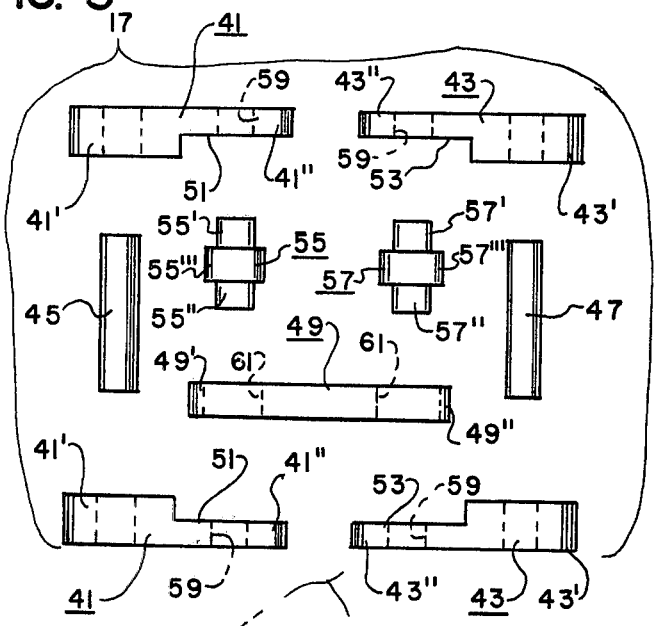
FIG. 3 is a exploded view of a connecting means of the handcuff assembly of the present invention.
Figure 4:
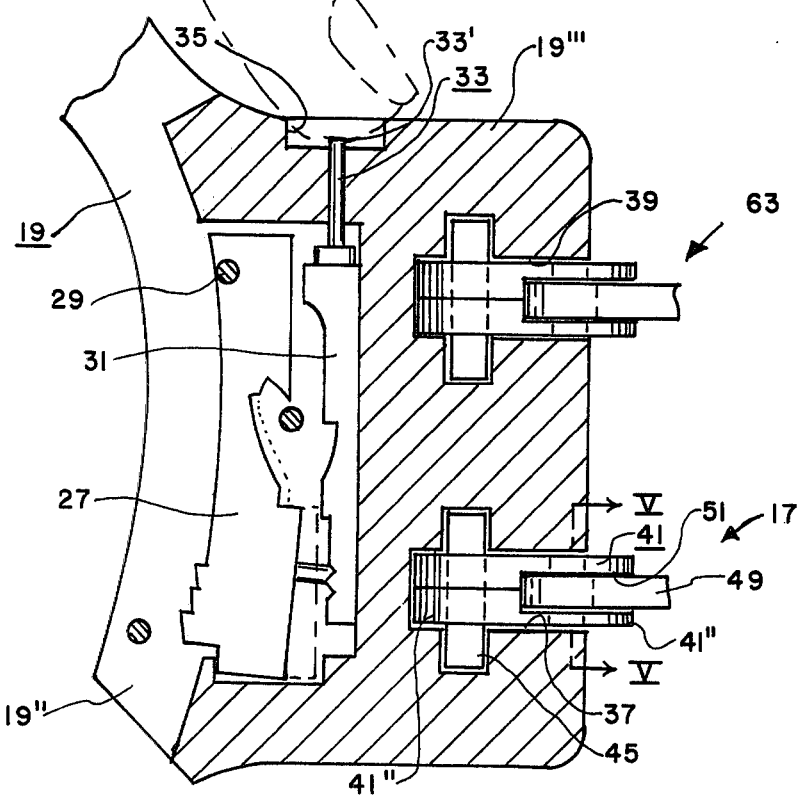
FIG. 4 is a somewhat diagrammatic sectional view of a portion of the handcuff assembly of the present invention.
Figure 5:
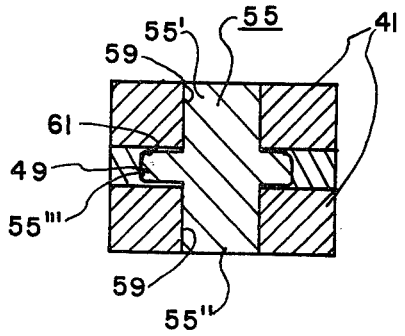
FIG. 5 is a sectional view as taken on line V—V of FIG. 4.
Figure 7:
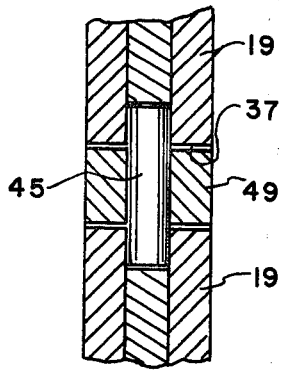
FIG. 7 is a sectional view as taken on line VII—VII of FIG. 6.
Figure 6:
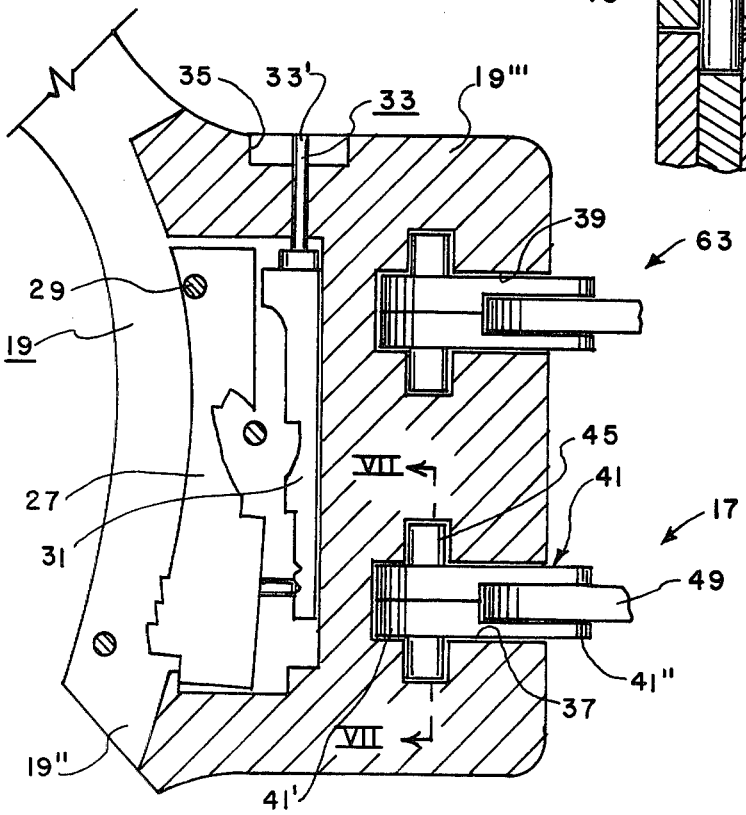
FIG. 6 is a view similar to FIG. 4 but with portions thereof in a moved position.

The wrist encircling means 13 may be substantially of any typical construction well known to those skilled in the art. In general, the first wrist encircling means 13 includes a first arm means 19 having a first end 19' and a second end 19'', includes a second arm means 21 having a first end 21' and a second end 21'', and includes a pivot means 23 for pivotally connecting the first ends 19', 21' of the first and second arm means 19, 21 to one another for allowing the first and second arm means 19, 21 to pivot between an open position in which the second ends 19'', 21'' of the first and second arm means 19, 21 are spaced apart from one another (see broken line representation in FIG. 1) and a closed position in which the second ends 19'', 21'' of the first and second arm means 19, 21 meet (see the solid line representation in FIG. 1) whereby one of the prisoner's wrists can be encircled by the first and second arm means 19, 21. The relationship of the arm means 19, 21 and the pivot means 23 allows the arm means 21 to pivot 360° about the pivot means 23 as will be apparent to those skilled in the art. The first wrists encircling means 13 preferably includes a first lock means for selectively preventing the first and second arm means 19, 21 from being pivoted from the closed position to the opened position after being locked into a prisoner's wrists. The first lock means may be of any typical construction well known to those skilled in the art. For example, the first lock means may include a plurality of teeth members 25 on the second end 21'' of the second arm means 21 and may include a plurality of teeth members 25 on the second end 21'' of the second arm means 21 and may include a keeper member 27 pivotally mounted to the second end 19'' of the first arm means 19 by way of a pivot pin 29 for engaging the teeth members 25 when the arm means 19, 21 are in a closed position whereby the arm means 19, 21 are prevented from being opened by unauthorized persons. The keeper member 27 can be moved by way of a key to an opened position as shown in broken lines in FIG. 4 whereby the arm means 19, 21 can be opened. It should be noted that a spring mechanism may be used to force the keeper member 27 against the teeth members 25 to thereby lock the arm means 19, 21 in the closed position. The first wrist encircling means 13 also preferably includes a second lock means for selectively preventing the first and second arm means 19, 21 from being closed pass a certain point to prevent the first and second arm means 19, 21 from being tightened about the prisoner's wrists after the second lock means is activated. The second means may include a slide member 31 for movement between a first position as shown in broken lines in FIG. 6 whereby the keeper member 27 of the first lock means can pivot to the opened position out of contact with the teeth members 25, and a second position as shown in solid lines in FIG. 4 whereby the keeper member 26 is prevented from movement to the opened position thereby preventing the keeper member 27 from being disengaged from the teeth members 25 thereby locking the first and second arm means 19, 21 in a specific position. The second lock means also includes a plunger member 33 having a first end 33' extending outward of the first arm means 19 when the second lock means is in an unlocked position and for being pushed inward by the person placing the handcuff assembly 11 on the prisoner's wrists to activate the second lock means by moving the slide means 31 to the second position. So far, the construction and operation of the first wrist encircling means 13 are of a typical nature well known to those skilled in the art such as the type manufactured by The Peerless Handcuff Co. of Springfield, Massachusetts and identified by U.S. Pat. Nos. 1,531,451 and 1,872,857. An inventive feature of the present invention is the elongation of the first end 33' of the plunger member 33 whereby the second lock means can be activated by being pushed inward by the thumb or finger of the person placing the handcuff assembly on the prisoner's wrists. It should be noted that the prior art handcuff assemblies required a special key to engage the plunger member thereof to activate the second lock means. An additional inventive feature of the present invention is the provision of a depressed portion 35 on the first arm means 19 where the first end 33' of the plunger member 33 is located when the second lock means is in an unlocked position to hinder accidental activation of the second lock means while allowing easy activation thereof with the thumb or finger of the person placing the handcuff assembly 11 on the prisoner's wrist. That is, the depressed portion 35 allows the plunger means 33 to be easily depressed by a person's thumb or finger without requiring the plunger means 33 to project beyond the outer boundary of the first arm means 19 which would increase the possibilities of the plunger means 33 being accidently depressed. The first arm means 19 preferably has an enlarged portion 19''' substantially adjacent the second end 19'' thereof. A pair of slots 37, 39 are preferably provided in the enlarged portion 19''' for reasons which will hereinafter become apparent. The specific construction of the first and second arm means 19, 21 may be in any manner now apparent to those skilled in the art. Preferably, the first arm means 19 may be made in a three layer sandwich type construction as will be apparent to those skilled in the art with the three layers joined together in any manner to those skilled in the art such as by rivets or the like.

The second wrist encircling means 15 is identical to the first wrist encircling means 13 and the above description of the first wrist encircling means 15 will be sufficient.

The connecting means 17 includes a first elongated body means 41 having a first end 41' for being pivotally attached to the first wrist encircling means 13 and having a second end 41'. The connecting means 17 also includes a second elongated body means 43 having a first end 43' for being pivotally attached to the second wrist encircling means 15 and having a second end 43''. The connecting means 17 also includes a coupling means for pivotally coupling the second end 41'', 43'' of the first and second body means 41, 43 to one another. The first end 41'' of the first body means is preferably received in the slot 37 in the enlarged portion 19''' of the first arm means 19. The first end 43' of the second body means 43 is likewise preferably received in the slot in the second arm means 21 that corresponds to the slot 37 in the enlarged portion 19''' of the first arm means 19.

The connecting means 17 preferably includes a first pivot pin 45 for extending transversely through the first end 41' of the first body means 41 and into the walls of the slot 37 in the first arm means 19 of the first wrist encircling means 13 to pivotally attach the first body means 41 to the first wrist encircling means 13. The connecting means 17 also preferably includes a second pivot pin 47 for extending transversely through the second end 43' of the second body means 43 and into the walls of the slot in the second wrist encircling means 15 that corresponds to the slot 37 in the first arm means 19 of the first wrist encircling means 13 to pivotally attach the second body means 43 to the second wrist encircling means 15. The coupling means of the connecting means 17 preferably includes an elongated body member 49 having a first end 49' for being pivotally attached to the second end 41'' of the first body means 41 and having a second 49'' for being pivotally attached to the second end 43'' of the second body means 43. The body means 41, 43 and the body member 49 are preferably substantially solid for giving strength to the connecting means. The first body means 41 preferably has a slot 51 in the second end 41'' thereof for receiving the first end 49' of the body member 49. Likewise the second body means 43 preferably has a slot 53 in the second end 43'' thereof for receiving the second end 49'' of the body member 49. The coupling means of the connecting means 17 preferably includes a first pivot pin 55 for pivotally connecting the first end 49' of the body member 49 and the second end 49'' of the first body means 41 to one another and preferably includes a second pivot pin 57 for pivotally connecting the second end 49'' of the body member 49 and the second end 43'' of the second body means 43 to one another. The pivot pins 55, 57 are preferably constructed so as to be knock-out proof to prevent unauthorized separation of the first and second wrist encircling means 13, 15. Each pivot pin 55, 57 may include a first end 55', 57', respectively, a second end 55'', 57'', respectively, and a midportion 55''', 57''', respectively. The first and second body means 41, 43 preferably have apertures 59 opening into the slots 51, 53 in the second ends 41'', 43'' thereof for receiving the first and second ends of the first and second pivot pins 55, 57. The first and second ends 49', 49'' of the body member 49 is likewise preferably provided with apertures 61 for receiving the midportion of the first and second pivot pins 55, 57. The midportions 55''', 57''' of the first and second pins 55, 57 are preferably larger in cross sectional areas than the apertures 59 in the body means 41, 43 to thereby prevent the pivot pin 55, 57 from being knocked-out of the apertures 59, 61 as will now be apparent to those skilled in the art. It should be noted that each body means 41, 43 are preferably made in two halves to allow easy assembly of the knock-out proof coupling means in a manner which should now be apparent to those skilled in the art.

Then handcuff assembly 11 preferably includes a second connecting means 63 for pivotally connecting the first and second wrist encircling means 13, 15 to one another. The second connecting means 63 is identical to the connecting means 17 and further description thereof is not necessary. The second connecting means 63 will increase the strength of the handcuff assembly 11 and will operate independently of the connecting means 17 so that if one connecting means 17, 63 should fail, the other would be sufficiently strong enough to adequately hold the first and second wrist encircling means 13, 15 together.

The present invention provides a handcuff assembly which restricts the movement of the wrist and hand of a prisoner to such an extent that a prisoner can not tamper with the locking mechanism of the handcuff assembly and restricts such movement without inflicting injury to the prisoner, which can be folded completely flat for storage in the handcuff case or over a belt without protruding, which can not be broken or disconnected by tampering with the hinge pin structure thereof, etc.

Although the present invention has been described and illustrated with respect to a preferred embodiment thereof, it is not to be so limited since changes and modifications may be made therein which are within the full intended scope of the invention.

I claim:

1. Handcuff assembly for selectively locking a prisoner's wrists together, said handcuff assembly comprising:

(a) a first wrist encircling means for selectively encircling one of the prisoner's wrists;

(b) a second wrist encircling means for selectively encirclying the other of the prisoner's wrists; and (c) tamper-proof connecting means for pivotally connecting said first and second wrist encircling means to one another, said connecting means including a first elongated body means having a first end for being pivotally attached to said first wrist encircling means and having a second end, said connecting means including a second elongated body means having a first end for being pivotally attached to said second wrist encircling means and having a second end, said connecting means including a coupling means for pivotally coupling said second ends of said first and second body means to one another, said coupling means including a pivot pin, said pivot pin including first and second ends and including a midportion, said second ends of said body means having apertures for pivotally receiving said ends of said pivot pin being larger in cross sectional area than at least a portion of said apertures in said second ends of said body means.

2. Handcuff assembly for selectively locking a prisoner's wrists together, said handcuff assembly comprising:

(a) a first wrist encircling means for selectively encircling one of the prisoner's wrists;

(b) a second wrist encircling means for selectively encircling the other of the prisoner's wrists; and (c) tamper-proof connecting means for pivotally connecting said first and second wrist encircling means to one another, said connecting means including a first elongated body means having a first end for being pivotally attached to said first wrist encircling means and having a second end, said connecting means including a second elongated body means having a first end for being pivotally attached to said second wrist encircling means and having a second end, said connecting means including a coupling means for pivotally coupling said second ends of said first and second body means to one another, said first wrist encircling means having a slot therein for receiving said first end of said first body means of said connecting means, said second wrist encircling means having a slot therein for receiving said first end of said second body member of said connecting means, said connecting means including a first pivot pin for extending transversely through said first end of said first body means of said connecting means and into the walls of said slot in said first wrist encircling means to pivotally attach said first body means to said first wrist encircling means, and said connecting means including a second pivot pin for extending transversely through said first end of said second body means of said connecting means and into the walls of said slot in said second wrist encircling means to pivotally attach said second body means to said second wrist encircling means.

3. The handcuff assembly of claim 2 in which the ends of said first and second pivot pins are completely enclosed by said first and second wrist encircling means, respectively.

4. The handcuff assembly of claim 2 in which said coupling means of said connecting means includes an elongated body member having a first end for being pivotally attached to said second end of said first body means of said connecting means and having a second end for being pivotally attached to said second end of said second body means of said connecting means.

5. The handcuff assembly of claim 4 in which said first and second body means of said connecting means have slots in the second ends thereof for receiving said first and second ends respectively of said body member of said coupling means of said connecting means, and in which said coupling means of said connecting means includes a first pivot pin for pivotally connecting said first end of said body member of said coupling means to said second end of said first body means and includes a second pivot pin for pivotally connecting said second end of said body member of said coupling means to said second end of said second body means.

6. The handcuff assembly of claim 5 in which said pivot pins of said coupling means of said connecting means are knock-out proof.

7. Handcuff assembly for selectively locking a prisoner's wrists together, said handcuff assembly comprising:

(a) a first wrist encircling means for selectively encircling one of the prisoner's wrists;

(b) a second wrist encircling means for selectively encircling the other of the prisoner's wrists; and (c) tamper-proof connecting means for pivotally connecting said first and second wrist encircling means to one another, said connecting means including a first elongated body means having a first end for being pivotally attached to said first wrist encircling means and having a second end, said connecting means including a second elongated body means having a first end for being pivotally attached to said second wrist encircling means and having a second end, said connecting means including a coupling means for pivotally coupling said second ends of said first and second body means to one another; said first wrist encircling means having a slot therein for receiving said first end of said first body means of said connecting means, said second wrist encircling means having a slot therein for receiving said first end of said second body member of said connecting means, said connecting means including a first pivot pin for extending transversely through said first end of said first body means of said connecting means and into the walls of said slot in said first wrist encircling means to pivotally attach said first body means to said first wrist encircling means, said connecting means including a second pivot pin for extending transversely through said first end of said second body means of said connecting means and into the walls of said slot in said second wrist encircling means to pivotally attach said second body means to said second wrist encircling means; said coupling means of said connecting means including an elongated body member having a first end for being pivotally attached to said second end of said first body means of said connecting means and having a second end for being pivotally attached to said second end of said second body means of said connecting means; said first and second body means of said connecting means having slots in the second ends thereof for receiving said first and second ends respectively of said body member of said coupling means of said connecting means, said coupling means of said connecting means including a first pivot pin for pivotally connecting said first end of said body member of said coupling means to said second end of said first body means and including a second pivot pin for pivotally connecting said second end of said body member of said coupling means to said second end of said second body means; said body means of said connecting means having apertures opening into said slots in said second ends thereof for receiving said pivot pins of said coupling means, each of said pivot pins of said coupling means of said connecting means including first and second ends for extending into said apertures in said body means and including a midportion, said midportion of each of said pivot pins being larger in cross sectional area than said apertures in said body means for receiving said pivot pins of said coupling means.

8. The handcuff assembly of claim 7 in which is included a second connecting means for pivotally connecting said first and second wrist encircling means to one another, said second connecting means being identical to said connecting means.

9. The handcuff assembly of claim 2 in which each of said wrist encircling means includes a first arm means having a first and second end, includes a second arm means having first and second ends, includes a pivot means for pivotally attaching said first ends of said first and second arm means to one another and for allowing said second ends of said first and second arm means to move towards one another so as to enclose one of the prisoner's wrists between said first and second arm means, includes first lock means for selectively preventing said second ends of said first and second arm means from moving away from one another, and includes second lock means for selectively preventing said second ends of said first and second arm means from moving towards one another, said second lock means including an elongated plunger means, said plunger means including a first end for extending outward of said first arm means when said second lock is unlocked and for being pushed inward by the finger of the person placing said handcuff assembly on the prisoner's wrists to activate said second lock means.

10. The handcuff assembly of claim 8 in which said first arm means has a depressed portion, and in which said first end of said plunger means is located within said depressed portion when said second lock means is unlocked to hinder accidental activation of said second lock means.

11. The handcuff assembly of claim 7 in which each of said first and second body means of said connecting means is constructed in two halves to allow an easy sandwich-like assembly thereof.

12. Handcuff assembly for selectively locking a prisoner's wrists together, said handcuff assembly comprising:

(a) a first wrist encircling means for selectively encircling one of the prisoner's wrists, said first wrist encircling means including a finger-activated lock means for selectively locking said first wrist encircling means in a specific position about the prisoner's wrist;

(b) a second wrist encircling means for selectively encircling the other of the prisoner's wrists, said second wrist encircling means including a finger-activated lock means for selectively locking said second wrist encircling means in a specific position about the prisoner's wrist; and (c) connecting means for for pivotally connecting said first and second wrist encircling means to come another, said connecting means including a first elongated body means having a first end for being pivotally attached to said first wrist encircling means and having a second end, said connecting means including a second elongated body means having a first end for being pivotally attached to said second wrist encircling means and having a second end, said connecting means including a coupling means for pivotally coupling said second ends of said first and second body means to one another, said coupling means including a pivot pin, said pivot pin including first and second ends and a midportion, said second ends of said body means having apertures for pivotally receiving said ends of said pivot pin, said midportion of said pivot pin being larger in cross sectional area than at least a portion of said apertures in said second ends of said body means.

* * * * *